United States Patent [19]

Silvestri, Jr.

[11] Patent Number: 4,780,057

[45] Date of Patent: Oct. 25, 1988

[54] PARTIAL ARC STEAM TURBINE

[75] Inventor: George J. Silvestri, Jr., Winter Park, Fla.

[73] Assignee: Westinghouse Electric Corp., Pittsburgh, Pa.

[21] Appl. No.: 50,178

[22] Filed: May 15, 1987

[51] Int. Cl.[4] ..... F04D 29/54

[52] U.S. Cl. ..... 415/202; 415/185; 415/194; 415/195

[58] Field of Search ..... 415/202, 194, 195, 208, 415/209, 210, 199.5, 181, 182, 183, 185

[56] References Cited

U.S. PATENT DOCUMENTS

| | | | |
|---|---|---|---|
| 740,332 | 9/1903 | Stumpf | 415/195 |
| 821,347 | 5/1906 | Elling | 415/195 |
| 1,883,868 | 10/1932 | Beckeman | 415/185 |
| 2,186,952 | 1/1940 | Bloomberg | 415/185 |
| 2,187,788 | 1/1940 | Kraft | 415/185 |
| 2,258,795 | 10/1941 | New | 415/194 |
| 2,294,127 | 8/1942 | Pentheny | 415/185 |
| 2,796,231 | 6/1957 | Hertl | 415/194 |

*Primary Examiner*—Robert E. Garrett
*Assistant Examiner*—John T. Kwon

[57] ABSTRACT

An improved partial arc admission system for a high pressure steam turbine, the system having a plurality of nozzle blade groups the blade aspect ratio of blades in each group vary according to the maximum pressure drop across each nozzle blade group.

6 Claims, 6 Drawing Sheets

PARTIAL ARC STEAM TURBINE

This invention relates to steam turbines and, more particularly, to apparatus for improving the efficiency of a partial arc admission steam turbine.

BACKGROUND OF THE INVENTION

The power output of many multi-stage steam turbine systems is controlled by throttling the main flow of steam from a steam generator in order to reduce the pressure of steam at the high pressure turbine inlet. Steam turbines which utilize this throttling method are often referred to as full arc turbines becuase all steam inlet nozzle chambers are active at all load conditions. Full arc turbines are usually designed to accept exact steam conditions at a rated load in order to maximize efficiency. By admitting steam through all of the inlet nozzles, the pressure ratio across the inlet stage, e.g., the first control stage, in a full arc turbine remains essentially constant irrespective of the steam inlet pressure. As a result, the mechanical efficiency of power generation across the control stage may be optimized. However, as power is decreased in a full arc turbine there is an overall decline in efficiency, i.e., the ideal efficiency of the steam work cycle between the steam generator and the turbine output, because throttling reduces the energy available for performing work. Generally, the overall turbine efficiency, i.e., the actual efficiency, is a product of the ideal efficiency and the mechanical efficiency of the turbine.

More efficient control of turbine output than is achievable by the throttling method has been realized by the technique of dividing steam which enters the turbine inlet into isolated and individually controllable arcs of admission. In this method, known as partial arc admission, the number of active first stage nozzles is varied in response to load changes. Partial arc admission turbines have been favored over full arc turbines because a relatively high ideal efficiency is attainable by sequentially admitting steam through individual nozzle chambers with a minimum of throtlling, rather than by throttling the entire arc of admission. The benefits of this higher ideal efficiency are generally more advantageous than the optimum mechanical efficiency achievable across the control stage of full arc turbine designs. Overall, multi-stage steam turbine systems which use partial arc admission to vary power output operate with a higher actual efficiency than systems which throttle steam across a full arc of admission. However, partial arc admission systems in the past have been known to have certain disadvantages which limit the efficiency of work output across the control stage. Some of these limitations are due to unavoidable mechanical constraints, such as, for example, an unavoidable amount of windage and turbulence which occurs as rotating blades pass nozzle blade groups which are not admitting steam.

Furthermore, in a partial arc admission system the pressure drop (and therefore the pressure ratio) across the nozzle blade groups varies as steam is sequentially admitted through a greater number of valve chambers, the largest pressure drop occurring at the minimum valve point and the smallest pressure drop occurring at full admission. The thermodynamic efficiency, which is inversely proportional to the pressure differential across the control stage, is lowest at the minimum valve point and highest at full admission. Thus the control stage efficiency for partial arc turbines as well as full arc turbines decreases when power output drops below the rated load. However, given the variable pressure drops across the nozzles of a partial arc turbine, it is believed that certain design features commonly found in partial arc admission systems can be improved upon in order to increase the overall efficiency of a turbine. Because the control stage is an impulse stage wherein most of the pressure drop occurs across the stationary nozzles, a one percent improvement in nozzle efficiency will have four times the effect on control stage efficiency as a 1 percent improvement in the efficiency of the rotating blades. Turbine designs which provide even modest improvements in the performance of the control stage nozzles will significantly improve the actual efficiency of partial arc turbines. At their rated loads, even a 0.25 percent increase in the actual efficiency of a partial arc turbine can result in very large energy savings.

SUMMARY OF THE INVENTION

Among the several objects of the invention may be noted the provision of an improved partial arc admission system for a high pressure steam turbine which overcomes several of the above discussed limitations and disadvantages, as well as others, of the prior art; the provision of such an improved system which includes a plurality of nozzle blade groups, each coupled to one or more different nozzle chambers in order to variably admit isolated steam flows to a first stage of rotatable blades; the provision of such an improved system which optimizes the aerodynamic efficiency of each nozzle blade group based on the structural limitations resulting from the maximum pressure drop occurring across each blade group; the provision of such an improved system wherein the blade aspect ratio for each nozzle blade group increases as a function of the predetermined sequence by which steam is admitted through each nozzle blade group; and the provision of such improved system including a maximized blade aspect ratio efficiency factor for each group of nozzle blades.

In general, there is provided an improved partial arc admission system for a high pressure steam turbine having a first stage of rotatable blades disposed about a rotatable shaft, the system comprising a plurality of arcuate nozzle blade groups forming a stationary nozzle ring about the rotatable shaft adjacent the first stage of rotatable blades, wherein each of the nozzle blade groups has a different blade aspect ratio. The partial arc admission system comprises a plurality of nozzle chambers each having an arcuate exit port disposed about the rotatable shaft for admitting an isolated steam flow thorugh each nozzle blade group to the first stage of rotatable blades; a plurality of control valves each coupled to a nozzle chamber to variably admit steam through the nozzle chamber exit ports to the first stage of rotatable blades; and a control system coupled to the control valves for admitting steam through each nozzle blade group in a predetermined sequence, the sequence beginning with steam admission through a first group of nozzle blades and ending with steam admission through the plurality of groups of nozzle blades. The blade aspect ratio for each group of nozzle blades sequentially increases according to the sequence by which steam is admitted through each group during turbine start up, the first group having a lowest blade aspect ratio and a last group having a highest blade aspect ratio. There is provided a plurality of nozzle blade groups each characterized by a minimum axial blade width corresponding to the maximum pressure drop occurring across a blade and each characterized by a maximum blade aspect ratio corresponding to a fixed blade height and a minimum axial blade width.

DETAILED DESCRIPTION

Figure 1:
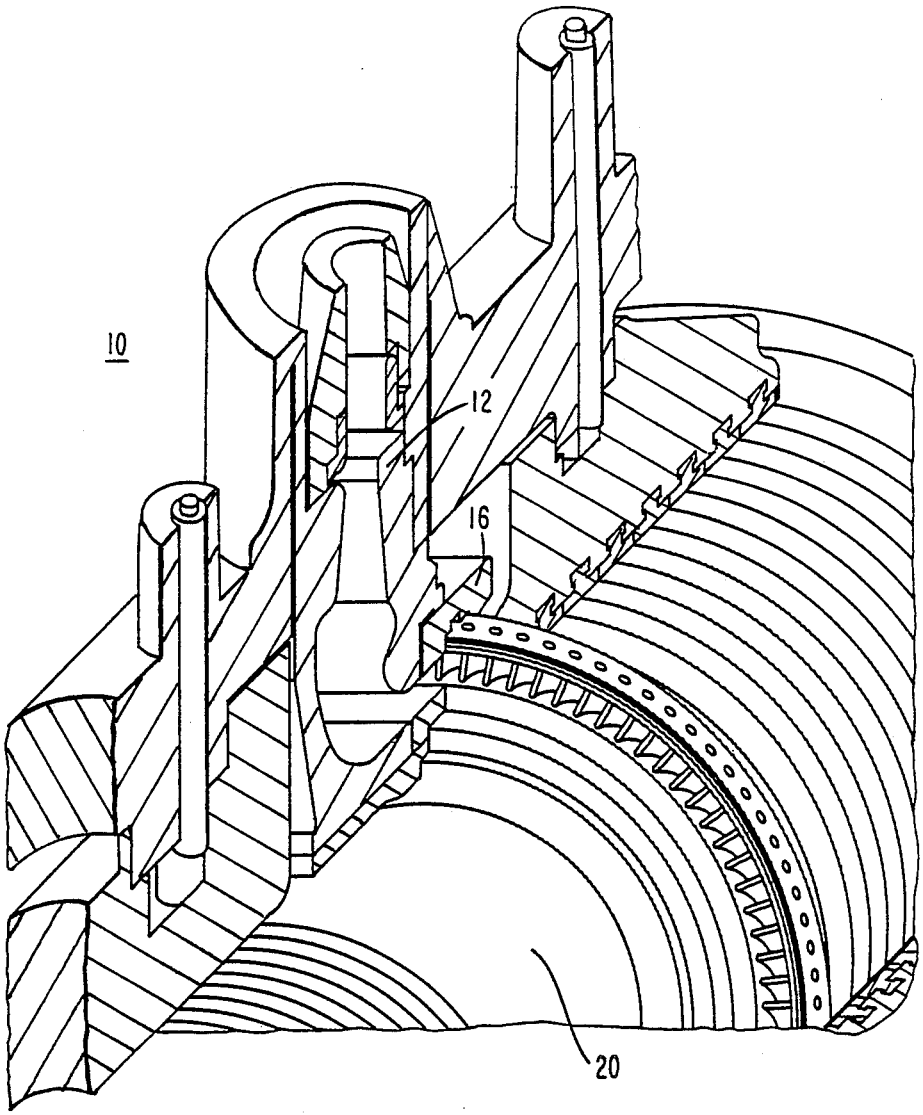
FIG. 1 is a partial sectional view along the turbine shaft at a first control stage of a typical high pressure steam turbine.
Figure 2:
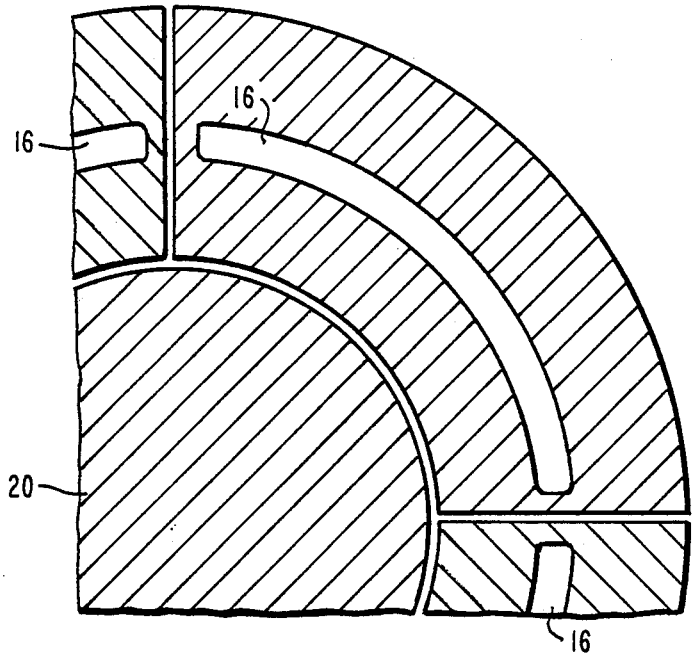
FIG. 2 is a partial cross-sectional view of the turbine of FIG. 1 taken along the turbine shaft at a nozzle chamber and illustrating a nozzle chamber exit port.
Figure 3:
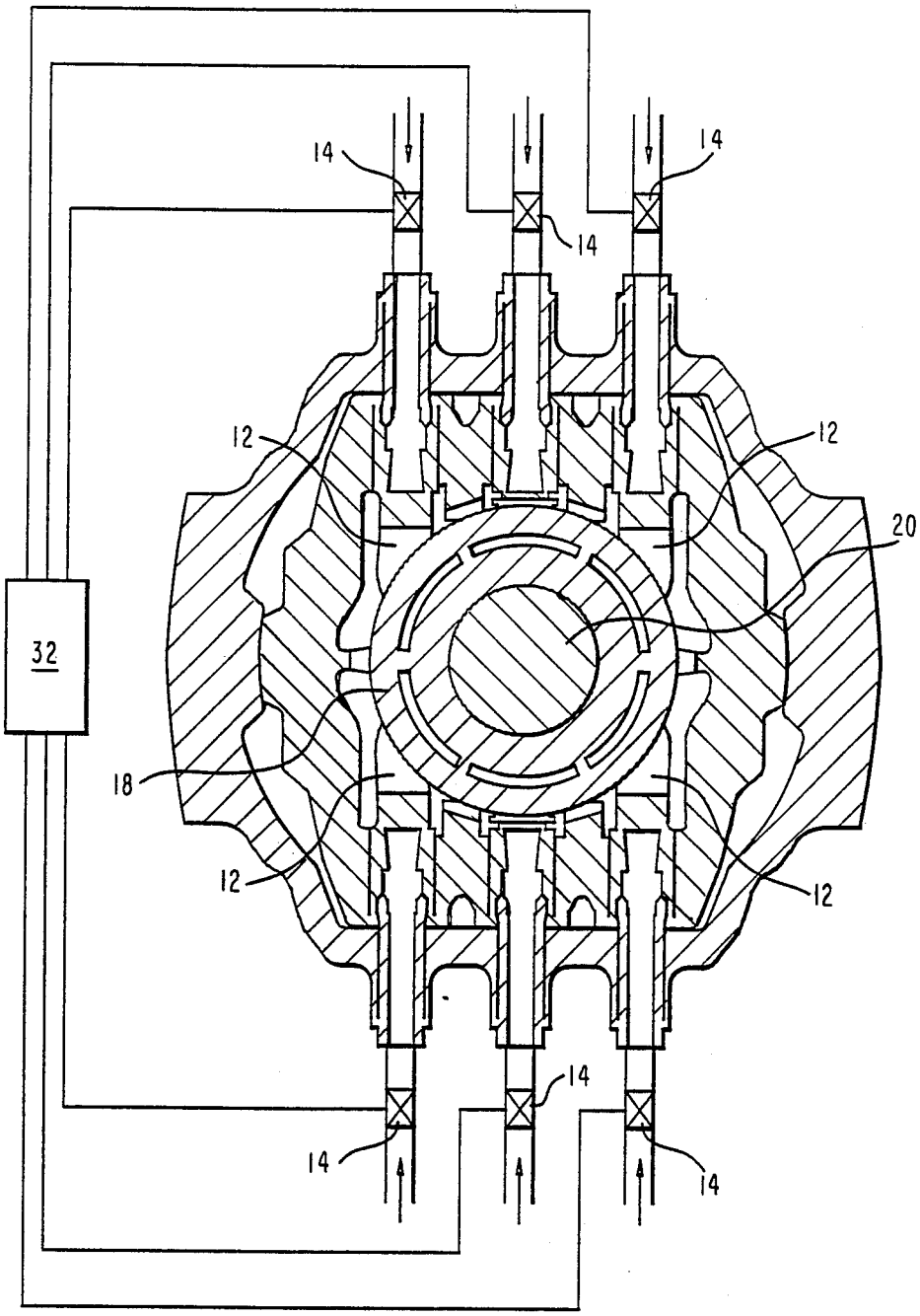
FIG. 3 is a cross-sectional view transverse to the shaft of the turbine of FIG. 1 illustrating an arrangement of nozzle chambers about the rotor shaft.
Figure 4:
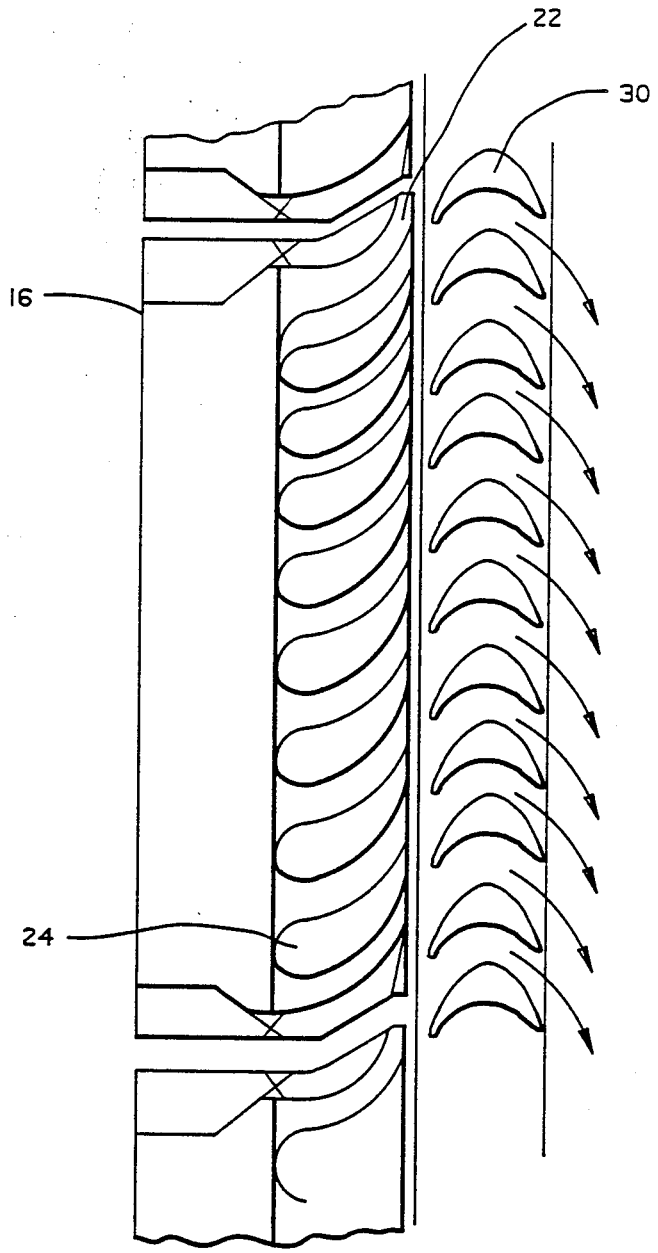
FIG. 4 is a simplified, partial radial view of the turbine of FIG. 1 showing a nozzle chamber exit port, a nozzle blade group and a plurality of rotating blades.

Before turning to the present invention, reference is first made to FIGS. 1–3 for a description of partial arc steam turbines and their operation. While the description will be given in terms of a "first control stage", those skilled in the art will appreciate that the invention is useful at any stage where partial arc admission is used, i.e., in any partial arc admission stage. A simple partial arc admission system having six segments of arc is illustrated in FIG. 3 for a typical 2400 PSI turbine 10. With a relatively constant throttle pressure delivered to the turbine, steam flow through each of six nozzle chambers 12 is sequentially regulated by a corresponding one of six control valves 14. Each nozzle chamber 12 provides an isolated steam flow through an arcuate exit port 16 shown in FIG. 2. The six exit ports illustrated in FIG. 3 form a segmented ring of admission 18 about the axial turbine shaft 20. As illustrated by the arrows shown in a radial view of one segment of arc in the control stage of FIG. 4, steam flows through each nozzle chamber exit port 16 into a corresponding arcuate group 22 of stationary nozzle blades 24. In a partial arc admission system, each group of nozzle blades receives an isolated steam flow from a corresponding nozzle chamber in order to provide a maximum flexibility for varying the arc of admission. The six nozzle blade groups 22 form a nozzle ring. The nozzle ring is adjacent the ring of admission 18 about the shaft axis. Each of the nozzle blade groups 22 directs steam, which is admitted through corresponding control valve 14, to the first stage of rotatable blades 30 connected to the turbine shaft.

By way of example, operation of the partial arc admission system shown in the FIGS. 1–3 is described during turbine start up. A control system 32 is coupled to the six control valves 14 in order to successively open the valves and admit steam through the nozzle chambers in a predetermined sequence. In this simple example, steam is initially throttled through a first nozzle chamber by gradually opening the corresponding control valve in order to transmit a minimum arc of steam through the ring of admission 18. The smallest arc of admission is commonly referred to as the turbine's primary valve point. In many partial arc admission systems the primary valve point is formed by simultaneously opening two or more control valves in order to form the minimum arc of admission through multiple exit ports. With reference to the simple example of FIG. 1, once the flow through the primary valve point is wide open, a second control valve gradually admitting until steam through another segment of the ring of admission 18, until the control valve is completely open and no longer throttling. This process continues for the remaining nozzle chambers until every segment of ring 18 admits steam to the first stage of rotating blades 30.

In certain turbine applications it is desirable to vary the steam flow below the primary valve point without control valve throttling. The process, which involves the varying of steam generator outlet pressure without throttling the corresponding control valves in order to control flow through the minimum arc of admission, is referred to as a hybrid sliding throttle pressure mode. While not all partial arc turbines incorporate this feature, it has been found that in fossil powered turbine systems, operation of partial arc turbines in the sliding throttle pressure mode results in an optimum part load efficiency when the minimum arc of admission is 50 percent. Operation at loads below 50 percent admission is accomplished by holding the arc of admission at 50 percent and varying steam generator outlet pressure while operating the corresponding control valves in unison.

Figure 5:
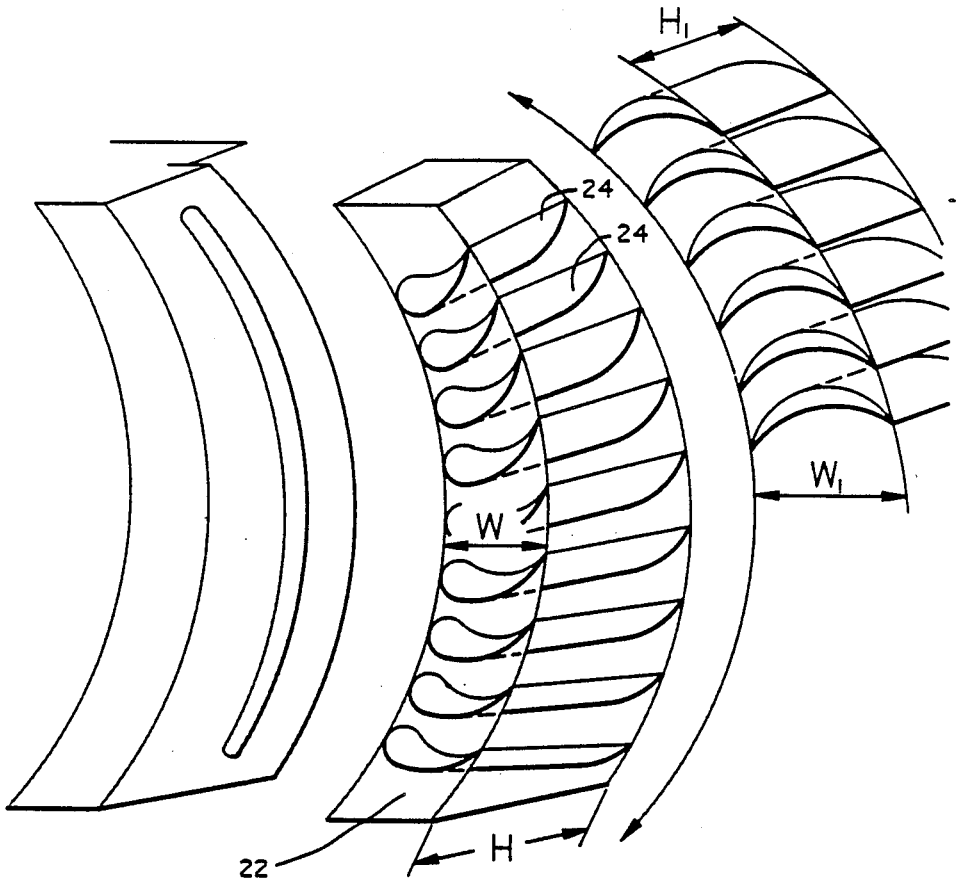
FIG. 5 is a simplified, exploded perspective view of the elements of FIG. 4 illustrating the geometric relationship between an arcuate nozzle chamber exit port, its corresponding arcuate group of stationary nozzle blades and a segment of the first stage of rotatable blades.

Generally, the control stage blading in high pressure turbines must be designed to withstand the maximum pressure drop present under normal operating conditions. With reference to FIG. 5, there is illustrated in an exploded perspective view a plurality of stationary nozzle blades 24 in one nozzle blade group 22 which direct high pressure steam flow from a nozzle chamber exit port 16 to the first stage of rotatable blades 30. The width, W, of each blade must be designed to withstand the maximum pressure forces incurred as the steam is directed to the rotating blades 30. In the past, this structural requirement has resulted in nozzle ring designs having unnecessary losses in blade efficiency. By way of example, nozzle blade design in a full arc turbine is now compared with nozzle blade design in the partial arc turbine illustrated in FIGS. 1–3.

The single pressure drop across the control stage nozzle blades in a full arc turbine requires that each of the nozzle blades have the same minimum axial width, W. Because there is an optimum nozzle blade spacing for efficient flow of steam through the nozzle ring, this structural requirement for a minimum blade width establishes the number of blades in the nozzle ring. The pitch to width ratio is a measure of this relationship between blade spacing and blade width, wherein the pitch is defined herein as the distance between nozzle blades in a given arc length.

Figure 6:
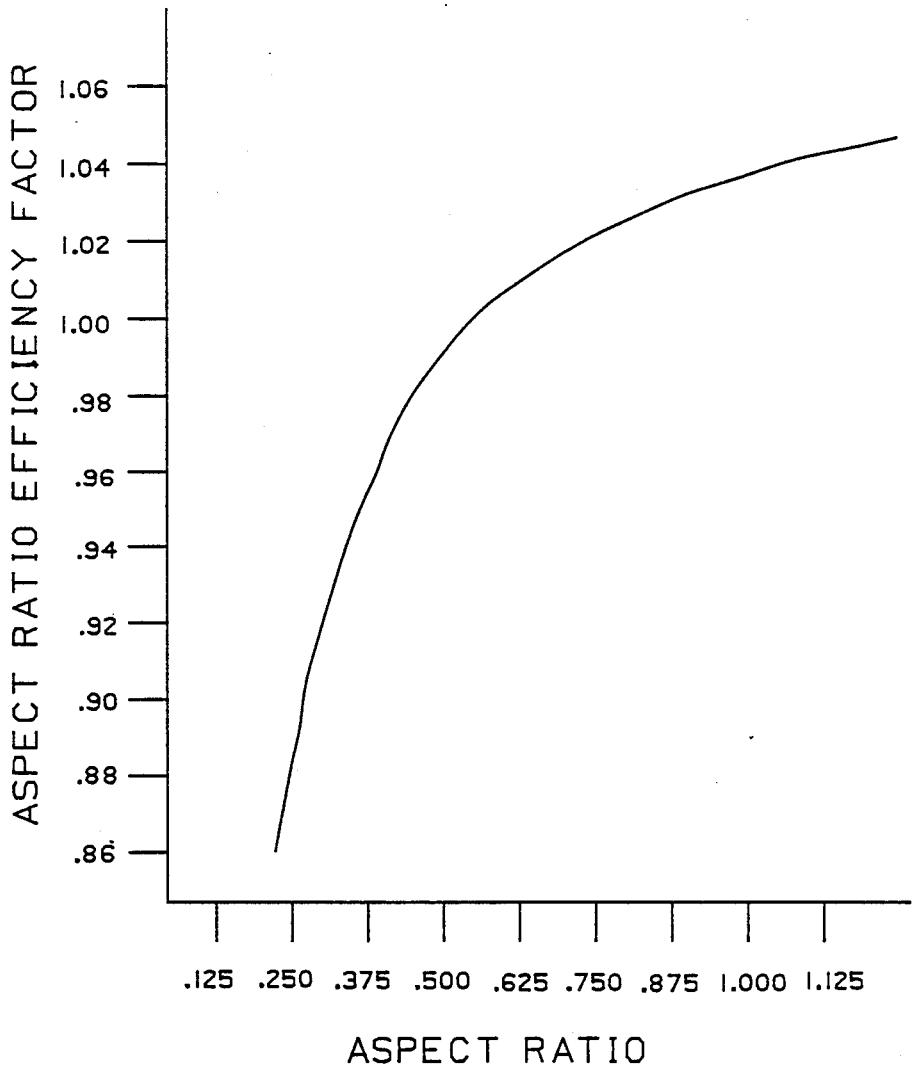
FIG. 6 illustrates the functional relationship between the blade aspect ratio efficiency factor and blade aspect ratio for a nozzle blade.

Blade efficiency is dependent upon several fluid flow effects, including viscous drag along the nozzle width, Reynolds number and the formation of various sized vortices in the regions of flow. Blade aspect ratio is an aerodynamic efficiency parameter relating to the performance of a nozzle ring based on these flow effects and is defined as the ratio of radial blade height, H, to axial blade width, W. Generally, as the blade aspect ratio increases, the overall blade efficiency also increases up to a point. The functional relationship between the aerodynamic efficiency of a nozzle blade and its blade aspect ratio is illustrated by the curve in FIG. 6 wherein the aspect ratio efficiency factor is plotted as a function of blade aspect ratio. The aspect ratio efficiency factor is an efficiency multiplier corresponding to the overall change in mechanical efficiency as blade aspect ratio is varied.

For a given pressure drop across the control stage and a corresponding minimum blade width, the nozzle blading in the control stage may be designed for an optimum aerodynamic efficiency. However, because increases in blade height affect the response to the vibratory stimuli present during partial arc admission and the need to limit the maximum steam temperature at the control stage discharge, and because a minimum blade width is necessary for a given pressure drop in order to maintain structural integrity, nozzle blade aspect ratio appears to have been treated in the past as a dependent variable rather than as a design parameter. This characterization has not been of major significance in full arc turbine performance, since each of the control stage nozzle blades must meet the same minimum width criteria. However, it has resulted in partial arc admission systems which perform below achievable levels of efficiency.

During successive opening of the control valves in partial arc turbine 10 a maximum pressure drop across each nozzle blade group 22 decreases as a function of the number of nozzle chambers 12 which are admitting steam at any given time. For example, for the typical 2400 PSI turbine unit illustrated in FIG. 1, the primary valve point, occurring at 33 percent admission, results in a 1550 PSI pressure drop across two of the six nozzle blade groups 30. The pressure drop decreases to 1190 PSI at 50 percent admission, to 990 PSI at 63 percent admission, to 720 PSI at 75 percent admission, to 570 PSI at 87 percent admission, and to 500 PSI at 100 percent admission. Some control stage designs have four arcs of admission, the minimum admission being 25% in some applications with a single control valve open and being 50% on other applcations with the first two control valves opening together. Still other designs have eight control valves supplying six nozzle chambers with the minimum admission varying being 25% and 50% depending upon the application. Notwithstanding the previously identified plurality of pressure drops, each of the control stage nozzle blade groups in partial arc turbines have, in the past, been designed in a manner similar to the design of nozzle blades in a full arc turbine, i.e., by requiring the same axial blade width, W, for each blade in the nozzle ring 26 in order to withstand the maximum pressure drop across the nozzle ring. This results in a less than optimum aerodynamic efficiency because the maximum pressure drop only occurs across the minimum arc of admission.

Given the variable pressure drops across the control stage of a partial arc turbine, the blade aspect ratio in each nozzle blade group can be optimized for its own maximum pressure drop. By way of example, the minimum arc of admission in the turbine of FIG. 1 involves two of the six nozzle blade groups 22. Only the nozzle blades which admit steam in this minimum arc of admission need be designed to withstand a 1550 PSI pressure drop. While the nozzle blades 24 which admit steam at 33 percent admission require a relatively large width in order to withstand the maximum pressure differences which occur at the minimum arc of admission, the width of other nozzle blades may be reduced without affecting the structural integrity of any control stage nozzles. Nozzles designed for a lower pressure drop will have smaller axial widths and correspondingly larger blade aspect ratios.

In practice this inventive concept may be applied to a wide variety of partial arc admission systems. For example, on a fossil powered partial arc turbine having six control valves and a primary valve point at 33 percent admission, the partial arc admission system could be redesigned for a hybrid sliding throttle pressure mode of operation at 50 percent minimum admission because the maximum pressure drop across a 50 percent arc of admission will be substantially smaller than the pressure occurring at the former 33 percent admission primary valve point. In addition to reducing the blade width in nozzle groups corresponding to 50 percent admission, each of the remaining nozzle blade groups may also be redesigned to optimize the blade aspect ratio for the maximum pressure drop across each segment of the nozzle ring. Generally, the blade width of a nozzle group may be selected for the pressure drop corresponding to the point where its control valve achieves the wide open positions during sequential opening of the control valves.

Furthermore, in turbines wherein the primary valve point is increased to 50 percent minimum admission in order to effect hybrid operation, the aspect ratio of the first stage of rotating blades 30, i.e., the ratio of radial blade height $H_1$, to axial blade width $W_1$, may also be increased in order to improve the control stage efficiency at both partial load and rated load. Although the resulting improvement in the blade aspect ratio efficiency factor for the rotating blades will not be as large as the corresponding improvement associated with the nozzle blades 24, a significant increase in overall turbine efficiency may nevertheless result.

There are additional benefits which result from applying the inventive concept of optimizing blade aspect ratios for specific pressure drops across the control stage nozzle ring 26 of a partial arc turbine. In the nozzle groups having blades with relatively smaller widths, W, than other blade groups in the nozzle ring, the blades should be more closely spaced in order to maintain the optimum pitch to width ratio for a given blade geometry. The resulting variation in blade spacings between different blade groups results in the damping of resonant vibrations which may occur in rotating blades as they periodically enter and exit arcs of steam admission.

These resonant effects result from the finite thickness of the nozzle blades. While steam flowing along each side of a nozzle blade eventually merges, there is a small localized velocity differential between the two flows of exiting steam due to boundary layer effects. As a result, there are small fluctuations in the speed of steam which strikes the rotating blades. These circumferential fluctuations provide a nozzle wake stimulus which is capable of setting up resonant vibrations. By providing different nozzle blade spacings in different nozzle groups, the corresponding blade excitation frequency will change as a function of blade position. These sequential changes in blade excitation frequency as the first stage of blades 30 rotate about the nozzle ring 26, minimize the reinforcement of any resonant responses and limit the amount of blade stress due to resonant vibration.

From the foregoing it is now apparent that a novel system for partial arc admission at the control stage of a steam turbine has been presented, meeting the objects set out hereinbefore as well as others, and it is contemplated that changes as to the precise embodiment of the inventive concept and details thereof may be made by those having ordinary skill in the art without departing from the scope of the invention as set forth in the claims which follow.

I claim:

1. A partial arc high pressure steam turbine (10) having improved efficiency comprising:

a. a rotatable shaft (20);

b. at least one stage of rotatable blades (30) disposed about said shaft (20);

c. a plurality of nozzle chambers (12) each providing an isolated steam flow to said rotatable blades (30) through a plurality of arcuate exit ports (16), the exit ports (16) forming a first ring (18) about said shaft (20);

d. a plurality of arcuate groups (22) of stationary nozzle blades (24) forming a nozzle ring adjacent the ring (18) of exit ports (16), each of said nozzle blade groups (22) being characterized by a different blade aspect ratio, defined as the ratio of radial blade height to axial blade width each nozzle blade group (22) being positioned to direct steam from a different one of the exit ports (16) to said stage of rotatable blades (30);

e. a plurality of control valves (14) each coupled to a corresponding one of the nozzle chambers (12) to variably admit steam through the nozzle chamber exit ports (16) to said first stage of rotatable blades (30); and f. control means (32) coupled to said control valves (14) for selectively controlling steam admission to said first stage of rotatable blades (30).

2. A partial arc steam admission system for a high pressure steam turbine (10) having at least one stage of rotatable blades (30) disposed about a rotatable shaft (20), said system (11) comprising a plurality of groups (22) of nozzle blades (24) forming a stationary nozzle ring (26) about the rotatable shaft (20) adjacent said stage of rotatable blades (30), selected groups (22) of nozzle blades (24) having different blade aspect ratios defined as the ratio of radial blade height to axial blade width.

3. The partial arc steam admission system of claim 2 further comprising:

a. a plurality of nozzle chambers (12) each having an exit port (16) disposed about the rotatable shaft (20) for admitting an isolated steam flow through a corresponding nozzle blade group (22) to said stage of rotatable blades (30), the plurality of exit ports (16) forming a ring (18);

b. a plurality of control valves (14) each coupled to a corresponding one of the nozzle chambers (12) to variably admit steam through the nozzle chamber exit ports (16) to said stage of rotatable blades (30); and c. control means (32) coupled to said control valves (14) for admitting steam through each of the groups (22) of nozzle blades (24) in a predetermined sequence, the sequence beginning with steam admission through at least one group (22) of nozzle blades (24) and ending with steam admission through the plurality of groups (22) of nozzle blades (24).

4. The partial arc steam admission system of claim 3 wherein the blade aspect ratio for each of the groups (22) of blades (24) sequentially increases from the first of the groups (22) to admit steam having the lowest blade aspect ratio to the last of the groups (30) to admit steam having the highest blade aspect ratio.

5. The partial arc steam admission system of claim 3 wherein steam is initially admitted through at least two of the groups of nozzle blades (22) in the predetermined sequence to form a minimum arc of steam admission and each of said rotatable blades (30) has a minimum axial blade width corresponding to a maximum pressure drop occurring across said rotatable blades when the steam is initially admitted.

6. The partial arc admission system (11) of claim 2 wherein at least two of the groups (22) of nozzle blades (24) have different pitch to width ratio, defined as the relationship between blade spacing and blade width, wherein the pitch is defined as the distance between nozzle blades in a given arc length.

* * * * *